US005993978A

United States Patent [19]

Kim et al.

[11] Patent Number: 5,993,978

[45] Date of Patent: Nov. 30, 1999

[54] ENGINE TAPPET OF HIGH ABRASION RESISTANCE AND METHOD FOR MANUFACTURING THE SAME

[75] Inventors: Kang Hyung Kim, Jinhae; Sae Il Oh; Maeng No Park, both of Changwon, all of Rep. of Korea

[73] Assignee: Volvo Construction Equipment Korea Co., Ltd., Rep. of Korea

[21] Appl. No.: 08/993,082

[22] Filed: Dec. 18, 1997

[30] Foreign Application Priority Data

| | | | |
|---|---|---|---|
| Jun. 21, 1997 | [KR] | Rep. of Korea | 97-26372 |
| Jun. 21, 1997 | [KR] | Rep. of Korea | 97-26373 |
| Jul. 7, 1997 | [KR] | Rep. of Korea | 97-31302 |

[51] Int. Cl.[6] ..... B22F 5/08; B22F 7/08

[52] U.S. Cl. ..... 428/553; 428/569; 75/240

[58] Field of Search ..... 75/240; 428/553, 428/569

[56] References Cited

U.S. PATENT DOCUMENTS

| | | | |
|---|---|---|---|
| 4,230,491 | 10/1980 | Behnke | 75/243 |
| 4,485,150 | 11/1984 | Tsuno | 428/633 |
| 4,778,522 | 10/1988 | Maki et al. | 75/238 |
| 4,863,513 | 9/1989 | Umeha et al. | 75/231 |
| 5,060,607 | 10/1991 | Tanaguchi | 123/90.51 |
| 5,859,376 | 1/1999 | Ishibashi et al. | 75/243 |

*Primary Examiner*—Daniel J. Jenkins

*Attorney, Agent, or Firm*—Harness, Dickey & Pierce, P.L.C.

[57] ABSTRACT

An engine tappet of high abrasion resistance, whose surface is coated with a sintered layer. This sintered layer is prepared from a binder comprising about 50–100 wt % of nickel powder, about 0–45 wt % of Cr, about 0–35 wt % of Mo, about 0–10 wt % of Al, about 0–25 wt % of Co, about 0–10 wt % of Cu and inevitably mixed impurities; and from hard particles selected from the group consisting of carbides, nitrides, borides and the mixtures thereof. Also, there is provided an engine tappet which is coated with an alloy powder composition comprising about 44–88 wt % of WC, about 4–10 wt % of Co, about 15–50 wt % of Ni, about 5–20 wt % of Cr, about 0.5–4 wt % of B, about 2–4 wt % of Fe, about 0.5–4 wt % of Si, about up to 1.0 wt % of C and inevitably mixed impurities.

9 Claims, 1 Drawing Sheet

ENGINE TAPPET OF HIGH ABRASION RESISTANCE AND METHOD FOR MANUFACTURING THE SAME

BACKGROUND OF THE INVENTION

1. Field of the invention

The present invention relates to an engine tappet superior in abrasion resistance and a method for manufacturing the same. More particularly, the present invention relates to a sintered layer coated on the surface of an engine tappet, which is superior in abrasion resistance and hardness but shows low fusibility to a cam. The sintered layer is prepared from a binder and a compound selected from the group consisting of carbide, boride and nitride or from a high melting point material with superior hardness but low fusibility to a cam. The tappet provided with such a sintered layer can be used in an over-head cam (OHC) type large-sized diesel engine.

2. Description of the invention

Referring to FIG. 1, there is shown a valve train system to open and close a cylinder valve 1. The valve train system comprises a rocker arm 3, a push rod 4 and a tappet 5. The valve 1 is provided with a valve spring 2 to confer restoring force on the valve 1.

Linked to the bottom of the push rod 4, the tappet 5 executes a sliding motion along the outer circumference of a cam. The tappet 4 moves up and down according to the fluctuation of the outer circumference of the cam 6, subjecting the push rod 4 to reciprocating motion.

In recent years, much effort has been made to develop valve train systems of long life span as the use condition for such valve train systems has been more serious in response to an increasing need for maintenance-free engines of high power and high fuel efficiency.

Any failure in such a valve train system causes incomplete combustion, leading to an increase in exhaust gas and smoke. Also, it may cause the engine to make noise and tremble excessively, deteriorating the performance of the whole automobile system.

Since the tappet 5, playing an important role in the valve train system, allows a sliding friction in the high speed contact with the cam 6, the failures in the tappet 4 come mostly from scuffing due to sliding wear and from pitting, a breakaway phenomenon due to surface fatigue.

In addition, since the scuffing and the pitting on the surface of the tappet 5 extremely aggravate the abrasion, the valve is caused to be untimely opened and closed and is problematic in air-tightening. Accordingly, the fuel is incompletely burnt, which results in the problems of exhaust gas and noise.

If an error exceeding a permissible limit exists in the tappet 5 or excessive abrasion is given to the tappet 5 upon the tappet's slide motion along the outer circumference of the cam 6, the tappet cannot be in accurate perpendicular contact with the cam, leading to a cam walking in which the load works in a parallel direction to a cam shaft In most cases, the tappet 5 and the cam 6 are made of steel and cast iron. These materials can be endowed with abrasion resistance and fatigue resistance by improving their surface hardness and leaving some compression stress in their surfaces through various surface hardening techniques including high frequency induction hardening, carburizing and nitriding.

Chilled cast iron is characterized by the deposition of primary cementite (Fe3C) which is accomplished by rapidly chilling upon casting. In terms of metallography, chilled cast iron is comprised of a pearlite matrix, which is changed from the austenite by Al transformation, and a needle type cementite structure.

Quench chilled cast iron, obtained by quenching and tempering the chilled cast iron, is comprised of a martensite or tempered martensite matrix, a cementite structure, and a temper carbon structure which is decomposed from the cementite structure.

The reason why these substances are dominantly used for the tappet is that the cementite structure is high in hardness and superior in abrasion resistance and the matrix structures prevent plastic flow from occurring, thereby making the tappet highly resistant to scuffing and pitting.

They, however, are problematic in several aspects on account of their being cast. For example, quench chilled cast iron is obtained following such complicated processes as melting, chilling, annealing, quenching and tempering. In addition, if chemical components, chilling speed and thermal treatment conditions are not constant, the cementite and the carbon are apt to be fluctuated in amount and the hardness of the matrix is also fluctuated due to friction heat and high face pressure, so that the resulting tappet becomes poor in abrasion resistance and also in scuffing resistance.

A tappet of high hardness may be prepared from the carbon steel or alloy steel whose surface becomes martensitic by carburization. This material, however, is found to be of lower abrasion resistance than chilled cast iron because martensite is inferior to cementite in thermal stability and also in hardness.

If cast iron materials are applied for the high efficiency engines in which the contact face pressure between the cam and the tappet continues to increase, the materials are required to undergo highly technical management in production, quality and process as well as are highly resistant to heat. However, the thermal resistance of the cementite cannot allow the materials to endure the high face pressure required by the engines as strong as or stronger than 300 horsepower.

To solve these and related problems several methods have been invented. For example, the tappet 5 is mounted in such a way that it is in contact with the cam 6 at oblique angles, to solve so-called cam walking. This method, however, exerts a negative effect of reducing the contact face between the cam 6 and the tappet 5 and aggravates abrasion. To overcome this, a technique was developed in which the surface of the tappet is subjected to crowning so that a combination of a point contact and a line contact is given between the tappet and the cam, thereby avoiding an extreme edge contact. The technique is still problematic in that, if the crown is small in radius, a cocking load is exerted on the surface of the tappet and jamming occurs between the cam and the tappet, causing an uneven surface or reverse flanks.

Calvin C. Connel suggests in U.S. Pat. No. 4,739,674 that the surface of tappet on which the sliding motion is done be a curved surface with a radius of at least about 1,500 m. However, it is difficult for the cam to have a theoretical curve line. In practice, the cam is usually crooked and thus, it is very difficult to expect that the durability of the tappet can be improved only by the shape of the curved surface. In addition, when the crowning radius is too large, a track of a concentric circle occurs on the account of the difference in curvature between the cam and the tappet, severely abrading the cam. Therefore, limitation is given to the solution using such a structural change.

Other solutions to the above problems are suggested in Japanese Pat. Laid-Open Pub. Nos. Sho. 62-182407 and Sho. 62-185806 which disclose a rocker arm and a tappet whose surfaces are fused with a sintered layer made of a nickel powder and a high temperature hard metal powder comprising a carbide, a nitride or a boride.

These above patents, however, introduce only the concept of fusing such a sintered layer but do not suggest the details for manufacturing techniques or methods. Further, the tappet and the rocker arm are economically unfavorable because their production cost including material cost is high.

SUMMARY OF THE INVENTION

Therefore, it is an object of the present invention to overcome the above problems encountered in prior arts and to provide an engine tappet, superior in abrasion resistance and durability and to provide a method for manufacturing the engine tappet.

It is another object of the present invention to provide an engine tappet, which allows a valve train system to be timely opened and closed, thereby preventing incomplete combustion and decreasing exhaust gas and smoke.

In accordance with an aspect of the present invention, there is provided an engine tappet of high abrasion resistance, whose surface is coated with a sintered layer prepared from a composition mixture of a binder and hard particles, said binder comprising about 50–100 wt % of nickel powder, about 0–45 wt % of Cr, about 0–35 wt % of Mo, about 0–10 wt % of Al, about 0–25 wt % of Co, about 0–10 wt % of Cu and inevitably mixed impurities; said hard particles being selected from the group consisting of carbides, nitrides, borides and the mixtures thereof. In accordance with another aspect of the present invention, there is provided a method for manufacturing an engine tappet of high abrasion resistance, comprising the steps of: molding a mixture composition comprising a binder and hard particles by a press; subjecting the molded substance to a primary sintering process; subjecting the sintered body on the surface of a tappet to a secondary sintering process to form a sintered layer on the tappet; and rapidly cooling the sintered layer of the tappet while pressurizing the sintered layer, to provide a high hardness to the surface of the sintered layer.

In accordance with a further aspect of the present invention, there is provided an engine tappet of high abrasion resistance, whose surface is coated with an alloy powder composition comprising about 44–88 wt % of WC, about 4–10 wt % of Co, about 15–50 wt % of Ni, about 5–20 wt % of Cr, about 0.5–4 wt % of B, about 2–4 wt % of Fe, about 0.5–4 wt % of Si, about up to 1.0 wt % of C and inevitably mixed impurities.

In accordance with still a further aspect of the present invention, there is provided a method for manufacturing an engine tappet of high abrasion resistance, comprising the steps of: coating the surface of the tappet with an alloy powder composition by heat spraying, to give a coat layer; and subjecting the coat layer to a remelting process.

BRIEF DESCRIPTION OF THE DRAWING

The above and other objects and aspects of the invention will become apparent from the following description of embodiments with reference to the accompanying drawing in which.

DETAILED DESCRIPTION OF THE INVENTION

Figure 1:
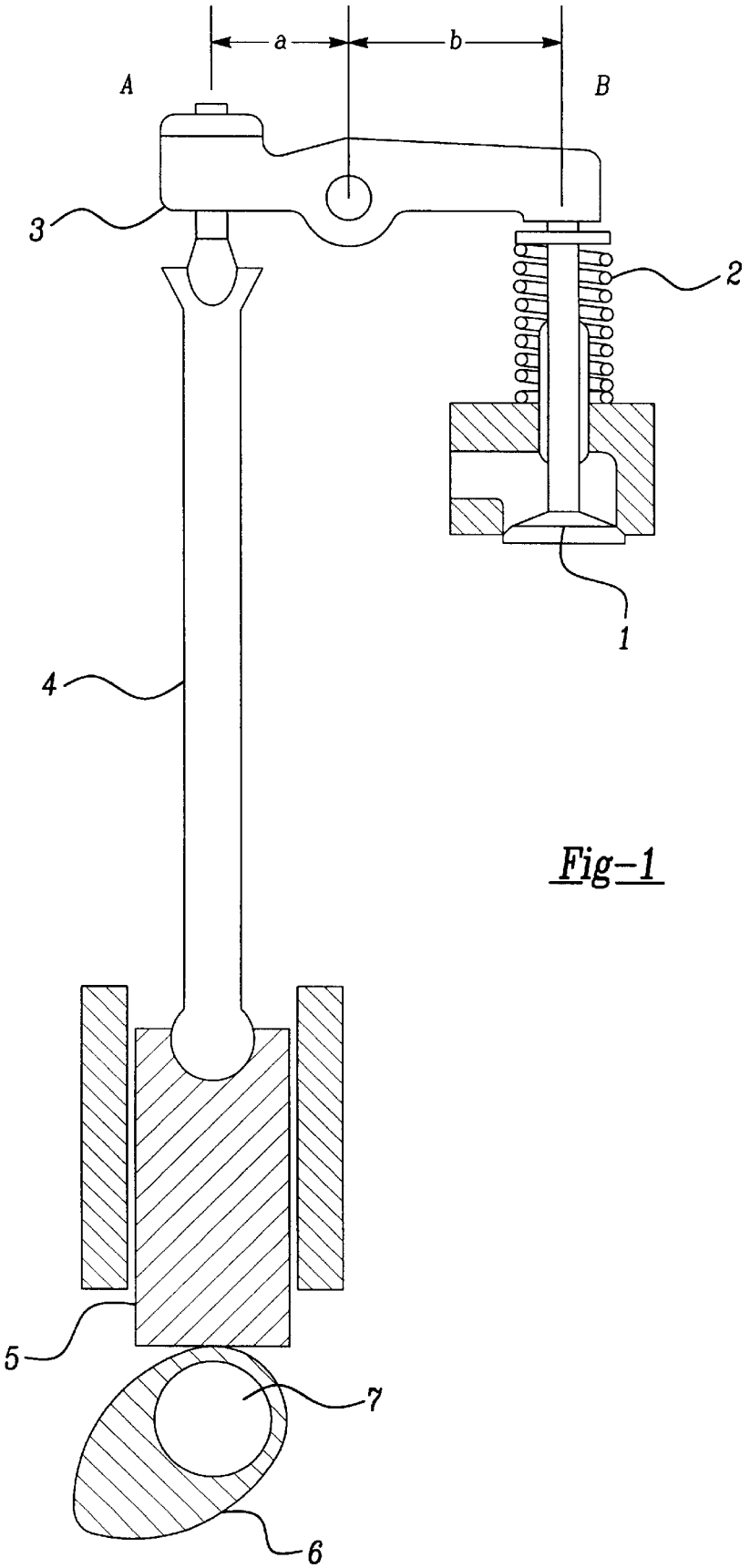
FIG. 1 is a schematic cross sectional showing a valve train system used in an over-head cam (OHC) type large-sized diesel engine.

Of the failures in a tappet, scuffing is attributed to the repeated local abrasion which results from the fact that the tappet, when being in contact with a cam, is frequently not rotated but causes a slide friction. To avoid this, a rolling contact is attempted to be induced. However, there is no effect in pitting resistance if the the tappet has a hardness vickers of 800 or less although the induction of rolling contact is done. Therefore, a higher hardness is preferred.

The breakaway due to excessive pressure and abrasion wear, if it locally occurs on the surface of the tappet at first, is rapidly spread to nearby regions, resulting in a peeling of the surface. In order to prevent this breakaway, the contact faces are required to have high hardness.

Being in sliding contact with each other, the cam and the tappet reciprocally affect their facing counterpart surfaces. If there is metallochemical affinity between the cam and the tappet, micro-cohesion occurs at the interface therebetween. At this time, the cohesion of the sliding motion surfaces between the cam and the tappet increases the coefficient of friction therebetween. The increased coefficient of friction, in turn, raises the friction heat at the contact faces, deteriorating the scuffing resistance.

If there is a difference in hardness and surface roughness between the cam and the tappet, the surface of the weaker of the two is broken. The particles abraded have a higher hardness than do their original states through work hardening.

Therefore, the reduction of the abrasion between the cam and the tappet can be done in the following two ways : first, reducing the coefficient of friction to lower the friction heat generated at the contact faces and improving scuffing resistance by use of high melting point material (high melting point carbide or nitride); second, employing a material lower in the cohesion to the cam, to prevent the surface damage of the cam.

The present invention uses these two ways, to provide a tappet superior in abrasion resistance.

In the first way, the present inventors found a method of forming on the surface of a tappet a sintered layer which is prepared from a binder comprising 50–100 wt % of a nickel powder, 0–45 wt % of Cr, 0–35 wt % of Mo, 0–25 wt % of Co. 0–10 wt % of Cu and inevitably mixed impurities, and from hard particles selected from the group consisting of carbides, nitrides, borides and the mixtures thereof.

Generally, Co is used as a base material for the binder since it is well known to have the best chemical and physical properties. In the present invention, Ni, instead of expensive Co, is used as a matrix material for the binder as it is inexpensive and provides a performance as good as that of Co.

In addition to being as effective as steel in hardness and elasticity, Ni shows a great affinity for the steel constituting the body of the tappet and has thermal resistance and corrosion resistance enough to allow the alloy to be used as a surface material for the tappet which is under a high temperature abrasion condition.

The Ni matrix can be reinforced by adding 45 wt % or less of Cr, 35 wt % of Mo, 10.0 wt % of Al, 25 wt % of Co and 10.0 wt % of Cu alone or in combinations and the melting point of the resulting alloy is lowered. Thus, a sintered body which is improved in pressure and abrasion resistance that is in direct correlation with pitting and scuffing resistance, can be manufactured with ease.

It is preferred that Ni is added at an amount of 50% or more of the total weight of the binder materials. For example, if Ni is used at an amount of 50 wt %, a decrease in toughness occurs. Further, since there is a large difference in coefficient of thermal expansion between the resulting alloy and the steel, the body of the tappet, the bonding strength therebetween is apt to be lowered.

During the solidification following sintering, Cr, together with the Ni, forms the compounds in which a δ phase, fatal to the thermal resistance and corrosion resistance, may exist when Cr is added at an amount larger than 45 wt %.

Together with other additive elements, Mo consolidates Ni, improving abrasion resistance. However, it is very expensive and its additive effect is not brought about if it is added at an amount larger than 35 wt %.

In the binder, the amount of Al is limited up to 10.0 wt %; otherwise, it is highly possible that a fragile β phase appears during the solidification.

Upon alloying, Co, able to form a complete solid solution together with Ni, also consolidates Ni, leading to an improvement in the abrasion resistance of the binder. Co, however, is expensive. Co is preferably added at an amount of 25 wt % or less as its additive effects are not exhibited when its amount exceeds 25 wt %.

As for Cu, it enables the binder to be of a higher resistance to corrosion and to seizure. Cu is preferably added at an amount up to 10 wt % because any more content deleteriously affects the strength of the sintered layer.

In the sintered layer of the present invention, the binder preferably has a volume fraction ranging from 30 to 60%. For example, the binder having a volume fraction lower than 30% is not satisfactory to the tappet in toughness and crack prevention effect. On the other hand, if the volume fraction of the binder exceeds 60%, the hard particles are of relatively small number so that the tappet becomes poor in pressure resistance.

As mentioned above, the hard particles constituting the sintered layer of the present invention, are made of a compound selected from the group consisting of nitrides, carbides, borides and the mixtures thereof. Of these, WC provides a high hardness, for example Hv 2400, and a high strength, for example, modulus of elatricity 7×104 MPa.

Experiment data of the present invention let the inventors know that the hard particles, when having an average diameter of 10 μm or larger, cause scuffing abrasion to the cam and pitting abrasion to the degree of about orobis class number 6 to 8 to the tappet. This experiment also shows that, when using hard particles 5 μm or smaller in average diameter, the pitting abrasion is satisfactorily improved to the state of orobis class number 9 or higher and that, if the hard particles are maintained below 2 μm in average diameter, there can be obtained a more satisfactory abrasion result, that is, a state of orobis class number 10 or higher, which shows no trace of scuffing abrasion.

The present invention also provides a method further comprising the coating of a separate brazing material on an adhering surface in order to improve the adherency between the sintered layer and the body of the tappet. Nickel or its alloy, such as nickel-chrome, may be used as the brazing material.

Following is a technique of sintering the above-mentioned materials on the surface of the tappet. To begin with, the binder materials and the hard particles are combined, molded into a predetermined form, and sintered to give a cermet. Following the primary sintering, the cermet is placed on the surface of the tappet and sintered again at a high temperature. At this time, the brazing material may be coated on the surface of the tappet prior to the application of the cermet to the tappet.

Generally, a cermet is obtained by liquid phase sintering. It is carried out at a high temperature of about 1,200–1,550° C. for 1–2 hours. This technique is effective in improving the density of the cermet because it decreases the porosity of the cermet. However, when heating at such a high temperature for an extended period of time, the hard particles are deformed from their original spherical shapes to rectangular shapes. These rectangular shapes are more disadvantageous in toughness, abrasion resistance and fatigue resistance than spherical shapes.

On the other hand, low temperature heating can prevent the hard particles from being deformed to rectangular shapes but cannot remove the fine pores from the hard particles.

According to the present invention, the cermet materials are molded in a press and subjected to primary sintering at 450–55° C. after which they are sintered on the body of the tappet at a temperature as high as or higher than 1,200° C., but for a maximum of 2 minutes, whereby the hard particles in the sintered body can be prevented from being deformed to rectangular shapes.

This rapid heating can be achieved by high frequency induction heating, flame heating, plasma heating or laser heating or by other techniques suitable for rapid melting.

The present invention is also characterized in that, after being formed on the surface of the tappet by the rapid heating, the sintered layer is rapidly cooled with pressurizing. In this state, compression stress remains in the surface of the sintered layer, enhancing its pressure resistance. For example, the surface of the sintered layer, which is in the course of solidification after the high temperature heating, is brought into contact with a flat cooling plate while pressurizing. The cooling plate comprises a cooling water line therein or uses a substance superior in thermal conductivity and its surface is coated with a poor adherency material, for example, a ceramic, such as graphite nitride, oxide, carbide, boride, etc, a cermet or a Ni—P material by chemical vapor deposition, physical vapor deposition, non-electrolytic plating, or spraying lest the plate should adhere to the sintered layer.

Alternatively, the heating coil which has been used for the sintering may be available for rapid cooling without an additional cooling plate. In this case, cooling water must be circulated within the heating coil lest the coil itself be heated to high temperatures. For example, after performing its heating function, the coil, which forms a flat plate shape as a whole, is electrically cut-off so as not to heat the tappet further, cooled with the circulating cooling water, and pressurized upon the sintered layer for the rapid cooling.

In the aforementioned second way, the present inventors found a method of coating on the surface of a tappet an alloy powder material comprising about 44–88 wt % of WC, about 4–10 wt % of Co, about 15–50 wt % of Ni, about 5–20 wt % of Cr, about 0.5–4 wt % of B, about 2–4 wt % of Fe, 0.5–4 wt % of Si, about up to 1.0 wt % of C, and inevitably mixed impurities.

Generally speaking, the members or parts which are required to be resistant to abrasion, must be good in two general properties, pitting resistance and scuffing resistance, in order to satisfy the requirement, although there might be a little difference according to the circumstance under which they are employed.

Thus, in order to obtain necessary scuffing resistance, tungsten carbide (WC), a hard compound as high as 1,300 in vickers hardness, which is able to enhance the resistance to sliding and, in order to reinforce pitting resistance, the contents of Co and Ni, which both can provide superior toughness in the rolling friction state under a high load, are controlled in the alloy.

The coating powder consists largely of the reinforcing phase and the matrix alloy.

Tungsten carbide responsible for the reinforcing phase and Co are mixed in a weight ratio of 88:12. Since tungsten carbide is easily exposed to the oxidizing atmosphere for the coating process, it is oxidized during flying so that the particles of tungsten carbide may be loosen or transformed from a stable WC phase into a quasi-stable phase, $W_2C_9$, $\eta$, or $\epsilon$. To prevent this problem, masses with appropriate sizes must be prepared by, for example, a sintering process after the mixing with Co. The carbide masses thus obtained range, in size, from several $\mu$m to hundreds $\mu$m but the carbides themselves, before the aggregation into the masses, must have an average size distribution ranging from 1 to 5 $\mu$m with an allowable maximal size of 5–7 $\mu$m. If the carbides alone are too large in size, the resultant coated surface may abrade the contact surface of the counterpart due to friction, so as to cause intense scratching, such as scoring, thereon.

It is preferable that the tungsten carbide amounts to about 44–80 wt % based on the total weight of the coating materials. For example, if the tungsten carbide amounts to less than 44 wt %, the coating layer is low in sliding resistance, one of the abrasion resistances required for a tappet useful in a high power engine as well as poor in hardness so that the resulting tappet has a low pitting resistance. On the other hand, if too much tungsten carbide is used, not only is it difficult to expect that the tungsten carbide play a role as a binder but also the coating layer is very low in density and shows brittleness, so that a brittleness failure occurs under the circumstance of high pressure.

Depending on the amount of tungsten carbide, Co may be added in a range of 4–10 wt %. Co forms a complete solid solution together with Ni and consolidates Ni in combination with the other additive elements, giving a contribution to abrasion resistance. In addition, Co plays a role of protecting the WC phase, as mentioned above.

The matrix alloy composition according to the second aspect of the present invention comprises about 15–50 wt % of Ni, about 5–20 wt % of Cr, about 0.5–4 wt % of B, 2–4 wt % of Fe, 0.5–4 wt % of Si, about up to 1.0 wt % of C, and a trace of inevitable impurities. If desired, Cu and/or Mo are allowed to be contained at an amount of about 1 wt % or less.

In addition to being almost the same with the steel in hardness and elasticity, Ni shows a great affinity for the steel constituting the body of the tappet. Further, Ni has such superior thermal resistance and corrosion resistance that it is suitable as a coating material for the tappet which is under a high temperature abrasion condition. Ni is preferably added at an amount of about 15–50 wt %. For example, if the content of Ni is below 15 wt %, it is insufficient for Ni to play a role as the mother alloy to form a solid solution for other alloy elements. On the other hand, the matrix alloy composition comprising Ni at an amount more than 50 wt % may come to have a brittle phase during the solidification after melting.

Cr is solid-soluble to and alloyed with Ni, with the aim of providing resistance to corrosion and heat and having superior strength. If comprising less than 5 wt % of Cr, the alloy is not provided with such effects from Cr. On the other hand, if Cr is added at an amount greater than 20 wt %, carbides form in the alloy, inducing heterogeneity and oxidation in the structure upon remelting treatment.

B and Si both can provide an eutectic reaction with Ni and/or Cr. This eutectic reaction is little effected when B and Si each are added at an amount less than 0.5 wt %. On the other hand, the effect cannot be improved further when they are used at an amount greater than 20 wt % because they are precipitated at crystal boundaries.

In a multi-element alloy composition, C improves the solid solubility of the matrix and disperses fine carbides upon rapid cooling to increase the strength of the matrix. C is preferably used at an amount of about up to 1 wt % because an excess of C remains as undissolved, fragile graphite.

The resulting alloy has a melting point still lower than typical alloys in a similar composition range because it has a range in which B and Si form an eutectic composition together with Ni and Cr.

Of the constituents for the matrix alloy, Ni and Co, similar to each other in physical properties, may be reciprocally replaced. Thus, Co, instead of Ni, may be used as the matrix element.

Cu can improve the corrosion resistance of matrix. However, it can decrease the strength of matrix if it is added at an amount greater than 1 wt %. Mo have an strengthening effect of matrix. On the other hand, the effect can not be improved further when it is used at an amount greater than 1 wt %.

Coating can be done by heat spraying, such as flame spraying, plasma spraying and high velocity oxygen fuel flame spraying. Spraying defectives which may exist within the coat can be easily removed by remelting it with the aid of an external heating source. For example, only the coat is heated to just above its melting point without damaging or melting the reinforcing phase and the coating base surface, so that a pore-free coat can be obtained and a metal bond can be achieved between the mother material and the coat.

However, where the coat layer is required to be far superior in scuffing resistance as well as in pitting resistance, preferably, high velocity oxygen fuel flame spraying guarantees excellent quality after the remelting process.

That is, the defectives of the spray coat layer can be eliminated by a post-remelting process but the best quality product can be obtained by the combination of a high velocity oxygen fuel flame spraying process and a remelting process.

Particles fly at a speed of 300 m/sec when carrying out an ordinary flame spraying process while the flying speed increases to 1,400–2,200 m/sec for the high velocity oxygen fuel flame spraying process. Thus, upon the high velocity oxygen fuel flame spraying, particles collide against the surface at such a high speed and this kinetic energy is transformed into a high heat energy. By virtue of this, there are scarcely any inner defectives in the coat.

When the product has a circular surface or the coating is carried out in a rotational manner, there occurs a difference in the coating rate between the center and the edge. Thus, a controlling means must be prepared to prevent the difference.

For the remelting of a tungsten carbide-dispersed coat, a heat source, such as oxygen-acetylene and oxygen-propane, is employed. There is needed a special torch whose flame holes are separated from each other at a distance of 10–25 mm. In this case, the intensity of the flame is required to be a little weaker than the flame intensity of an ordinary torch.

Care must be taken not to heat local regions at high temperatures upon the remelting because the coating layer experiences a rapid thermal expansion to a breakaway state. For example, the product is preheated up to 330–550° C. at a distance of 100–130 mm. Then, the torch nozzle is moved to the distance of 30–40 mm from the product and the heating is stopped at the point that the surface of the product turns from a red state to a fluid state by a drastic change of fluidity. If there is overheating or the heating time is extended, the surface is melted flowing down or is oxidized. Optimally, the remelting process is carried out at 1,050–1100° C. for several seconds to one minute. The product is slowly cooled with aid of an appropriate medium.

Since the shape of a cold forged tappet makes it asymmetric or non-uniform for the tappet to absorb heat from the source, a sound quality of tappet cannot be obtained.

Thus, in the present invention, a tappet is subjected to a remelting process as fixed on a lathe or a turn table. In this state, preheating is done perpendicularly to the rotating axis not only upon the front surface but also to the central part which is slowly heated and cooled. In result, the tappet can be remolten at a uniform temperature throughout in spite of a thickness difference between the edge and the central part.

The remelting can be achieved in a heating manner using a heat treatment furnace or high frequency as well as a torch. If temperature and calorie both are adequately controlled, a good quality is possible.

A better understanding of the present invention may be obtained in light of following examples which are set forth to illustrate, but are not to be construed to limit, the present invention.

EXAMPLES I THROUGH IV

Binder compositions as indicated in the following Table 1 were used in which the average particle size was 4 μm for Ni powder and 4–10 μm for the other addition alloys. WC with average particle sizes as indicated in the table was mixed with the binder materials in such a way that the binders had a volume fraction ranging from 35 to 55% and then, the mixtures were molded by a press, followed by a primary sintering of the molded mixtures at 500° C. These sintered bodies each were bonded to a tappet through a brazing nickel alloy consisting of 7.0 wt % of Cr, 3.0 wt % of Fe, 3.2% of Cu, 4.5 wt % of Si and the remnant amount of Ni. While the tappet was rotated, sintering was carried out at a temperature of 1,200–1,350° C. as indicated in the following table, for 2 min by use of a high frequency induction heater with a capacity of 200 KHz, 1500 KW. Thereafter, a copper plate which was non-electrolytically plated with nickel and had a cooling water line therein, was used as a cooling plate. After the completion of the sintering, the binder-integrated tappets were rapidly cooled by the cooling plate while pressuring them with the aid of an oil-hydraulic cylinder provided on the center of the cooling plate.

Finally, the sintered layers thus formed on the tappets were subjected to polishing, to have a thickness of 0.7 mm.

An abrasion test was done in a single-acting tappet-cam tester by testing the obtained tappets for pitting resistance under the following condition: speed 1,000 rpm; static spring load 174.5 kg, test numbers 107 cycles; oil lubricant temperature 75–85° C.

The results are given as shown in the following table 1.

Comparative Examples I Through IV

Binder compositions as indicated in the following Table 1 were used in which the average particle size was 4 μm for Ni powder and 4–10 μm for the other addition alloys. WC with an average particle size of 7.5 μm was mixed with the binder materials in such a way that the binders had a volume fraction ranging from 35 to 60% and then, the mixtures were molded by a press. The remnant procedures were carried out in the same manner with those of Examples I through IV except that the sintering temperature ranged from 1,250 to 1,400° C. The results are given as shown in the following table 1.

Comparative Example V

A binder composition as indicated in the following Table 1 was used in which the average particle size was 4 μm for Ni powder and 4–10 μm for the other addition alloys. WC with an average particle size of 3.0 μm was mixed with the binder materials in such a way that the binder material had a volume fraction of 45 vol % and then, the mixture was molded by a press. The remnant procedures were carried out in the same manner with those of Examples I through IV except that the sintering temperature was 1,200° C. and a cooling plate was not used. The results are given as shown in the following table 1.

TABLE 1

| | Binder | | WC | Sinter- | Abrasion Test | | | |
|---|---|---|---|---|---|---|---|---|
| Exmp. Nos. | Volume Fraction (vol %) | Chemical Composition (wt %) | Avg. Size (μm) | ing Temp. (° V) | Hard-ness (HV) | Pitting Resist. (Orob. No) | Cam Adapt-ability | Cooling Plate |
| 1 | 35 | 85 Ni, 11 Cr, 4 Mo | 2.0 | 1,200 | 970 | 10 | O | yes |
| 2 | 40 | 75 Ni, 10 Co, 10 Cr 4 Mo, 1 Al | 2.0 | 1,250 | 890 | 10 | O | yes |
| 3 | 45 | 100 Ni | 5.0 | 1,200 | 930 | 9 | O | yes |
| 4 | 55 | 80 Ni, 10 Cr, 4 Mo 2 Al | 5.0 | 1,350 | 870 | 9 | O | yes |
| C.1 | 35 | 85 Ni, 16 Cr, 2 Mo | 7.5 | 1,400 | 930 | 9 | X | yes |
| C.2 | 40 | 85 Ni, 5 Co, 11 Cr 4 Mo | 7.5 | 1,250 | 980 | 9 | X | yes |
| C.3 | 50 | 95 Ni, 2 Cr, 3 Mo | 7.5 | 1,400 | 940 | 7 | X | yes |
| C.4 | 60 | 85 Ni, 10 Cr, 4 Mo 1 Cu | 7.5 | 1,350 | 700 | 7 | ê | yes |
| C.5 | 45 | 75 Ni, 5 Co, 15 Cr 2 Mo, 3 Cu | 3.0 | 1,200 | 800 | 7 | O | no |

EXAMPLE V

An alloy powder which had WC—Co alloy as an reinforcing phase and Ni autogenous melting alloy as a matrix was prepared from a mixture comprising 61.6 wt % of WC, 8.4 wt % of Co, 19.8 wt % of Ni, 5.4 wt % of Cr, 2.6 wt % of B, 2.1 wt % of Fe, 1.2 wt % of Si, 0.3 wt % of C and inevitably mixed impurities. Tungsten carbide, as it was, had an average particle size of 3–4 μm while WC—Co on the spraying phase ranged, in average particle size, from 15 to 45 μm.

The powder was spray-coated on the surface of a tappet by using a high velocity oxygen fuel flame spraying process. This tappet was fixed on a rotating turn-table and preheated to 450° V. at a distance of 100 mm from a heating source using oxygen:acetylene of 3:4. After that, the torch nozzle was drawn to the distance of 30 mm from the surface of the tappet which was, then, remolten at 1,050° C. for 1 min.

After being cooled slowly, the final product thus obtained had a coat layer which was 6 μm in thickness and HRA 85 in hardness. Observation with an optical microscope showed that there were no pores in the structure of the coat layer and that WC particles were uniformly distributed throughout the coat layer.

An abrasion test was done in a single-acting tappet-cam tester by testing the obtained tappet for pitting resistance under the following condition: speed 1,000 rpm; static spring load 174.5 kg, test numbers 107 cycles; oil lubricant temperature 75–85° C. The tappet was found to be in a normal contact with the cam, showing orobis no. 9 and good cam adaptability but neither pitting nor scuffing.

As described hereinbefore, the engine tappet of the present invention is superior in pitting resistance and scuffing resistance both. Therefore, it is endurable and preventive of engine noise and incomplete combustion.

Other features, advantages and embodiments of the present invention disclosed herein will be readily apparent to those exercising ordinary skill after reading the foregoing disclosures. In this regard, while specific embodiments of the invention have been described in considerable detail, variations and modifications of these embodiments can be effected without departing from the spirit and scope of the invention as described and claimed.

What is claimed is:

1. An engine tappet of high abrasion resistance, whose surface is coated with a sintered layer prepared from a composition mixture of a binder and hard particles, said binder comprising about 50–100 wt % of nickel powder, about 0–45 wt % of Cr, about 0–35 wt % of Mo, about 0–10 wt % of Al, about 0–25 wt % of Co, about 0–10 wt % of Cu and inevitably mixed impurities; said hard particles being selected from the group consisting of carbides, nitrides, borides and the mixtures thereof.

2. An engine tappet in accordance with claim 1, wherein said binder has a volume fraction of about 30–60 vol % in the composition mixture.

3. An engine tappet in accordance with claim 1, wherein said hard particles are made of tungsten carbide.

4. An engine tappet in accordance with claim 1, wherein said hard particles have an average size of 5 μm or smaller.

5. An engine tappet in accordance with claim 1, wherein said sintered layer has a hardness of HV 800 or higher.

6. An engine tappet in accordance with claim 1, wherein said sintered layer is bonded through a brazing material to the surface of the tappet.

7. An engine tappet in accordance with claim 6, wherein said brazing material is nickel or nickel alloy.

8. An engine tappet of high abrasion resistance, whose surface is coated with an alloy powder composition comprising about 44–88 wt % of WC, about 4–10 wt % of Co, about 15–50 wt % of Ni, about 5–20 wt % of Cr, about 0.5–4 wt % of B, about 2–4 wt % of Fe, about 0.5–4 wt % of Si, about up to 1.0 wt % of C and inevitably mixed impurities.

9. An engine tappet in accordance with claim 8, wherein said WC has an average particle size of 5 μm or smaller.

* * * * *